US007194783B1

(12) United States Patent
Hunt

(10) Patent No.: US 7,194,783 B1
(45) Date of Patent: Mar. 27, 2007

(54) WINDOW BLIND CLEANING APPARATUS

(75) Inventor: Gene C. Hunt, 2901 S. Michigan Ave., Apt. #1106, Chicago, IL (US) 60616

(73) Assignee: Gene C. Hunt, Chicago, IL (US)

( * ) Notice: Subject to any disclaimer, the term of this patent is extended or adjusted under 35 U.S.C. 154(b) by 531 days.

(21) Appl. No.: 10/783,614

(22) Filed: Feb. 20, 2004

(51) Int. Cl.
*A47L 4/00* (2006.01)

(52) U.S. Cl. ..... 15/321; 15/322; 15/394; 15/397; 239/565; 239/566

(58) Field of Classification Search ..... 15/321, 15/394, 396, 395, 322, 397; 134/166 R, 134/171–172, 198–199; 239/550, 565–568, 239/600; *A47L 4/00, 4/02, 4/04*
See application file for complete search history.

(56) References Cited

U.S. PATENT DOCUMENTS

| | | | | | |
|---|---|---|---|---|---|
| 890,044 | A * | 6/1908 | Godbey | 239/565 |
| 2,271,694 | A * | 2/1942 | Johnson | 15/394 |
| 2,789,307 | A * | 4/1957 | Sussman et al. | 15/394 |
| 3,045,275 | A * | 7/1962 | Delacretaz | 15/394 |
| 3,419,251 | A * | 12/1968 | Eckert | 239/566 |
| 3,610,417 | A * | 10/1971 | DeLoach | 134/198 |
| 4,252,572 | A * | 2/1981 | Schaming | 134/199 |
| 4,574,415 | A | 3/1986 | Vitonis | |
| 4,718,141 | A | 1/1988 | Kuehnl | |
| 4,787,118 | A | 11/1988 | Weiland et al. | |
| 4,879,782 | A | 11/1989 | Jacobson | |
| 4,897,122 | A | 1/1990 | Schreiber et al. | |
| 4,920,601 | A | 5/1990 | Alburas | |
| 5,400,468 | A | 3/1995 | De Petra | |
| 6,269,823 | B1 * | 8/2001 | Lincoln | 134/198 |

* cited by examiner

*Primary Examiner*—Theresa T. Snider
(74) *Attorney, Agent, or Firm*—James S Pristelski

(57) ABSTRACT

A cleaning head for cleaning the slats in a window blind includes a manifold for receiving cleaning fluid, a plurality of spaced apart fingers arranged in a row on the manifold and at least one orifice defined in each finger for spraying the cleaning fluid onto the slats. Cleaning pads may be disposed on the fingers to contact the slats. The manifold may be divided to provide a source of vacuum to a second plurality of fingers with apertures defined therein for removal of excess cleaning fluid. Another embodiment of the cleaning head has couplings extending laterally from the fingers, and spacing elements may be interposed between the couplings to vary the spacing between adjacent fingers. Yet another embodiment of the cleaning head utilizes an enclosed compartment with slots defined in upper and lower surfaces for receiving a slat through the compartment.

6 Claims, 5 Drawing Sheets

20
22
24
26
27
28
29
30
32
34
36
40
41
42
44
45
46
47
48
49
50
52

WINDOW BLIND CLEANING APPARATUS

FIELD OF THE INVENTION

The present invention relates generally to cleaning apparatus. More particularly, the invention relates to apparatus for cleaning window blinds with a cleaning fluid.

BACKGROUND OF THE INVENTION

Window blinds are commonly installed in office buildings, commercial businesses and governmental offices to for any of a variety of reasons. These reasons include regulating the amount of light desired in the office, blocking direct sunlight, increasing energy conservation and efficiency and providing for privacy. Blinds also tend to have a longer useful lifetime than other window treatments, such as drapes. Window blinds are also preferred by many home owners as part of the interior décor of the home.

Such window blinds typically consist of a plurality of slats in parallel, spaced-apart relationship. Some means is usually provided for controlling the angular position of the slats such that the slats may be angularly rotated between an open position, which permits the maximum passage of light through the blinds, and a closed position, which provides for maximum blockage of light through the blinds. Over a period of time, dust, particulate matter, and the like, accumulate on the blinds. Most undesirably, bacteria and pathogenic organisms may also be present on the blinds. Due to the large number of blinds, each with a plurality of slats, which may be installed in commercial buildings, individual cleaning of each slat, even occasionally, becomes a very time-consuming and laborious task.

Some prior art references have attempted to remove dirt accumulations on the blinds with a specially formed brush. For example, U.S. Pat. No. 4,574,415 to Vitonis discloses a dusting and cleaning brush with a plurality of finger-like brushes extending from a handle. U.S. Pat. No. 4,879,782 to Jacobson also discloses a hand tool for cleaning blinds with rollers retained on fingers. U.S. Pat. No. 5,400,468 to De Petra teaches the use of opposed rollers and is limited to cleaning one slat of the blinds at a time. Other prior art, such as U.S. Pat. No. 4,787,118 to Weiland et al. is concerned with a vacuum brush device with a plurality of elongated fingers that is connected to a source of vacuum. U.S. Pat. No. 4,718,141 similarly employs a plurality of finger-like brushes connected to a source of vacuum to remove dust from the slats of blinds. Such prior art is typical of the use of friction surfaces and/or vacuum to dislodge dirt accumulations on the blinds, but with limited success. For example, some dirt is too well adhered to the surfaces of the blinds to be removed with brushes and/or vacuum. Such cleaning devices and techniques are also generally unsuccessful where any greasy-type residues are on the blinds since any dust accumulations will tend to adhere to the residues. Such residues cannot be fully removed with friction and/or vacuum.

There has been a long-felt need for apparatus to more effectively and efficiently clean the slats of window blinds.

Accordingly, it is a general object of the present invention to provide a cleaning head for window blinds that cleans the slats of the blinds with a cleaning fluid.

Another object of the present invention is to provide a cleaning head for cleaning of window blinds that also removes excess cleaning fluid.

Yet another object of the present invention is to provide a cleaning head for window blinds that includes a plurality of fingers and in which the spacing between the fingers may be varied with spacing elements to adapt to the needs of different spacing between the slats of the window blind.

A further object of the present invention is provide a manifold with an internal divider to provide two chambers in the manifold, a first chamber for providing cleaning fluid to a plurality of fingers and a second chamber for providing a source of vacuum to a second plurality of finger for removal of excess cleaning fluid.

A still further object of the present invention is to provide an enclosed compartment for the cleaning of a slat of the window blind.

BRIEF SUMMARY OF THE INVENTION

This invention is directed to apparatus for cleaning of the slats of a window blind with a cleaning fluid. A cleaning head with a plurality of fingers that extend between the slats simultaneously cleans a plurality of the slats. A source of pressurized cleaning fluid is supplied to a manifold. A plurality of spaced apart fingers is arranged in a row on the manifold. At least one orifice is defined in the side of each finger to spray the cleaning fluid onto the slats of the window blind. Cleaning pads may be provided over each finger to contact the slats for improved cleaning. An extendible mast may be attached to the manifold for cleaning of taller blinds.

The manifold may have an internal divider to provide two internal chambers in the manifold. A first chamber provides the pressurized cleaning fluid to the plurality of fingers. A second chamber is in gaseous communication with a source of vacuum, which is provided to a second plurality of spaced apart fingers, also arranged in a row on the manifold, to remove any excess cleaning fluid.

The present invention is also directed a cleaning head with a coupling extending laterally from opposed sides of each of the plurality of fingers used to spray cleaning fluid onto the slats of the blind. The couplings may attach directly to a corresponding coupling on an adjacent finger to provide fluid communication for the delivery of the cleaning fluid to each finger. Spacing elements may also be utilized between the couplings to vary the spacing between adjacent fingers to correspond to the spacing between the slats of the blind.

The present invention further includes a cleaning head that includes compartments in which the cleaning of the slats of the blind is done internally within the compartment. The compartment may include a generally rectangular enclosure with a top surface, a bottom surface, side surfaces and an internal area. Slots are defined in the top and bottom surfaces such that a portion of the slat of the blind extends through the compartment. A fluid delivery tube, in communication with a source of cleaning fluid, is disposed through a side of the rectangular enclosure. An orifice is defined near the end of the fluid delivery tube to spray cleaning fluid onto the slat in the interior portion of the enclosure. A cleaning fluid removal tube, also disposed through a side of the enclosure has one end in communication with a source of vacuum to remove any excess cleaning fluid in the enclosure at an aperture defined in an opposite end. Preferably, the cleaning fluid removal tube is disposed near the bottom surface of the enclosure. Cleaning pads may be disposed internally in the enclosure to make contact with the slat of the window blind.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the figures in which like reference numerals identify like elements, and in which:

DESCRIPTION OF THE PREFERRED EMBODIMENT

Figures 1, 2, 3:
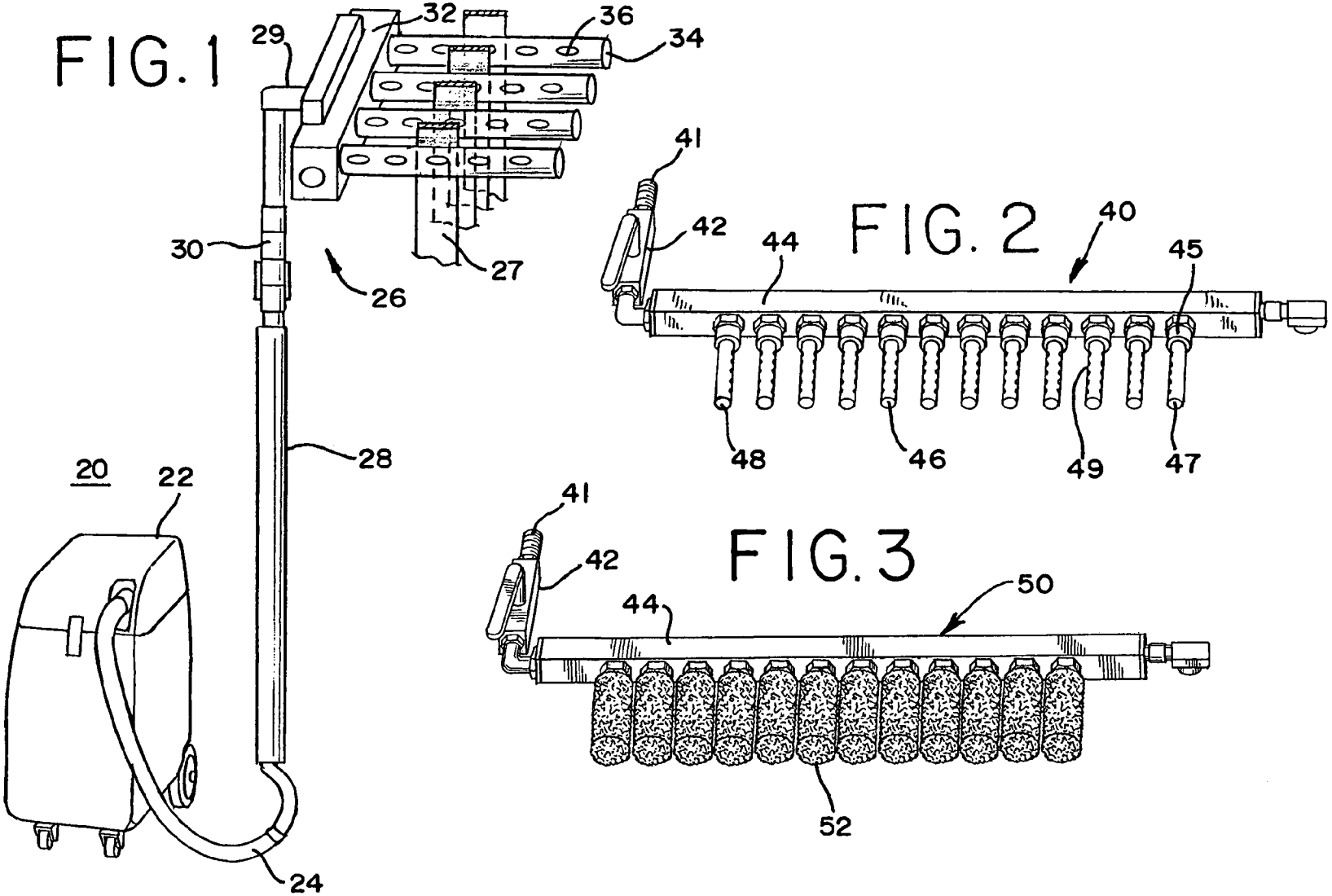
FIG. 1 is a perspective view of a window blind cleaning system in accordance with the present invention.
FIG. 2 is a perspective view of an alternate embodiment of a cleaning head with a plurality of spaced-apart fingers to fit between pairs of slats in the window blinds.
FIG. 3 is a perspective view of a cleaning head of the type illustrated in FIG. 2 with cleaning pads disposed over each of the plurality of fingers.

A window blind cleaning system, generally designated 20, constructed in accordance with the present invention is shown in FIG. 1. A machine 22 may be employed to provide a source of pressurized cleaning fluid. Machine 22 may also provide a source of vacuum. For example, machine 22 may be similar to machines used for cleaning of carpeting that selectively provide cleaning fluid during one phase of the cleaning operation and that selectively provide a source of vacuum during another phase of the cleaning operation to remove the excess cleaning fluid. Machine 22 may alternatively provide both the pressurized cleaning solution and the source of vacuum simultaneously to remove excess cleaning fluid as it is being applied, as further disclosed below.

The cleaning fluid may be any desired cleaning fluid, including detergents, solvents, window cleaning solutions, multi-purpose cleaning solutions and the like. Such cleaning solutions may be pre-mixed with water or may be mixed when the cleaning solution is added to machine 22. If desired, the cleaning solution may also be water without any added detergent or the like. Machine 22 may also have a heating element to preheat the cleaning solution, such as to about 180° to 220°, prior to application of the heated cleaning solution to the window blinds to improve the cleaning performance, which may be in the form of steam for some blinds.

Machine 22 preferably has one or more flexible hoses or conduits 24 for supplying the cleaning fluid from machine 22 to a cleaning head, generally designated 26, for cleaning window blinds 27. In the embodiment illustrated in FIG. 1, cleaning head 26 is provided with a mast 28 having telescopically extending portions 30 to extend the length of mast 28, such as is needed to clean lengthy window blinds associated with taller windows typically encountered on the first floor of office or commercial buildings. Mast 28 may end in a right angle portion 29 that attaches to a manifold 32 of the cleaning head 26. Right angle portion 30 may be rotatably affixed to manifold 32 such that manifold 32 may be rotated with respect to mast 28 by about 90° for cleaning of window blinds with horizontally disposed slats.

Manifold 32 has a plurality of extending fingers 34 that are spaced apart from each other, such that fingers 34 can each extend between adjacent slats of the window blind 27. While the distance between fingers 34 is fixed in this embodiment, window blinds may typically be adjusted to provide a compatible spacing between the respective slats of the blinds 27, such that one of the fingers 34 can be inserted between each of pair of adjacently located slats of the blinds. In FIG. 1, the slats of the blind 27 are illustrated as being of narrower width than the length of fingers 34 to better illustrate the features of the fingers. It will be appreciated by those skilled in the art that in practice, it may be desirable to have fingers 34 be about the same length, or shorter than, the width of the slats of the blind 27 to avoid any unnecessary over-spray from fingers 34 which wastes the cleaning fluid and which may necessitate further cleaning of any over-sprayed areas.

Fingers 34 are provided with one or more spraying heads or orifices 36 to provide the cleaning fluid from machine 22 through hose 24, through mast 28, through manifold 32 and through fingers 34 to both sides of the slats 27 of the window blind. Thus, fingers 34 and orifices 36 are in fluid communication with the cleaning fluid supplied by machine 22. In the embodiment of FIG. 1, orifices 36 are provided on both lateral sides of the fingers 34 to provide spraying application of the cleaning fluid directly onto the slats 27. For purposes of illustration, the orifices 36 in FIG. 1 are shown considerably larger than will be typically implemented. Ordinarily, the orifices 36 will be quite fine such that enough cleaning solution is sprayed onto the slats 27 to provide adequate cleaning, and at the same time, minimizing the amount of cleaning fluid used. The number of orifices 36, the size of the orifices, the spraying pattern of the orifices and the spacing between the orifices, depends upon various design choices, as will be appreciated by those skilled in the art. For example, if the orifices are miniature spraying heads with a wider spraying pattern and the slats of the blinds to be cleaned are narrow, only one orifice 36 may be required. On the other hand, if the spraying pattern is narrower and the slats of the blinds are wider, it may be desirable to provide several orifices in each finger 34.

It is an objective to provide a relatively uniform spray from the orifices 36 in fingers 34 to the slats 27. However, due to the nature of spraying nozzles or orifices, uniformity of the spray is often difficult to achieve in actual operating conditions. In any event, as the cleaning head is moved in an up and down direction in FIG. 1, the orientation of the orifices 36 with respect to the slats 27 will be continually changing, which will enhance the distribution of the cleaning solution on the slats 27, and which will therefore make up for any shortcomings in the uniformity in the spraying patterns from the orifices 36.

Cleaning head 26 may also be removably attached to the mast 28, such as at the right angle portion 29. For example, it may be desirable to attach a manifold with fingers 34, with larger apertures than the orifices 36 used for applying the cleaning solution, to apply a vacuum to the slats 27 to remove any excess cleaning solution at the completion of cleaning. Another reason for removably attaching cleaning head 26 from the mast 28 is to provide a cleaning head with different spacing between fingers 34 for cleaning of slats 27 that have a correspondingly greater or smaller spacing therebetween.

FIG. 2 illustrates a cleaning head, generally designated 40 that may be manually held, such as for cleaning of smaller or shorter window blinds. In particular, this embodiment is not provided with a mast 28 as for the cleaning head 26 as illustrated in FIG. 1. Cleaning head 40 has an inlet 41 for receiving a cleaning fluid, such as from the machine 22 via a hose 24, and a manually operable valve 42 to selectively supply cleaning fluid to the cleaning head. A manifold 44 in fluid communication with the inlet 41 distributes the cleaning fluid to a plurality of fingers 46 for spraying onto the slats of a window blind. If desired, the cleaning fingers 46 may be attached to the manifold 44 with a threaded fastener or fitting 45. This will also facilitate removal and replacement of the fingers 45 with other similar fingers that may have different spraying patterns, different lengths to accommodate different widths of slats in window blinds, and the like. Each finger 46 is provided with one or more orifices 49, such as at a side or lateral position. Each of the fingers 46 is typically spaced from the adjacent fingers to approximate the spacing between the slats of the blinds, or the blinds may be adjusted to correspond to the spacing between the fingers 46. Those fingers 47 and 48, which are at the ends of the row of fingers 46 are preferably provided with orifices only in the inner direction, and not in the outer direction, such that cleaning fluid is not sprayed out into the room when no slat is at the outer side of the end fingers 47 and 48.

Figure 9:
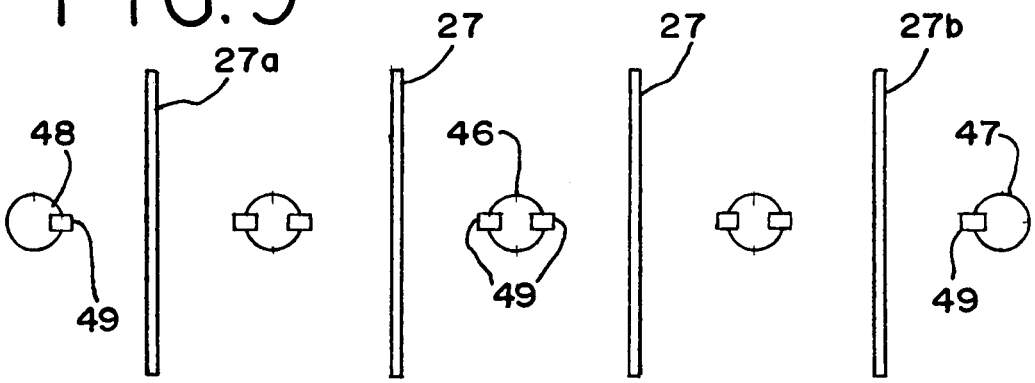
FIG. 9 is a diagrammatic view of a plurality of cleaning fingers disposed between the slats of a window blind with interior fingers having spray heads directed in opposing directions and with outer fingers having spray heads directed inwardly only.

For example, the drawing in FIG. 9 diagrammatically illustrates an interior finger 46 with opposite nozzles, spray heads, or orifices for spraying a cleaning solution onto the interior slats 27 disposed on both sides of finger 46. However, the finger 48 at the left side of FIG. 9 has only one orifice directed to the right to spray the corresponding end slat 27*a*. In a related manner, opposite end finger 47 has only one orifice 49, but directed to the left to spray the corresponding end slat 27*b*. While FIG. 9 shows five fingers 46–48, any desired number of fingers may be implemented to meet the needs of the number of slats in the particular window blinds to be cleaned. Of course, where the number of slats in the blind is greater than the number of fingers in the cleaning head, the blind may be cleaned by multiple passes of the cleaning head through different portions of the blind.

As with the cleaning head 26 in FIG. 1, a separate cleaning head similar to cleaning head 40 of FIG. 2 may be provided with larger orifices on the fingers 46 to be used with vacuum applied to inlet 41 for removing any excess cleaning fluid from the slats of the blind.

FIG. 3 shows a cleaning head 50 that is similarly configured to the cleaning head 40 in FIG. 2. However, cleaning pads 52 have been added to each of the fingers 46 and the end fingers 47 and 48. These cleaning pads desirably absorb cleaning fluid from the fingers 46–48 for application to the slats of the window blind that may be disposed between the pads 52. Preferably, cleaning pads 52 come into physical contact with the slats disposed therebetween to simultaneously clean both sides of each slat, such as by rubbing or friction, in combination with the cleaning fluid, to loosen any dirt or stains that may be difficult to remove by spraying alone.

Cleaning pads 52 are shown as being cylindrical in shape with an axially disposed cylindrical opening for sliding of the cleaning pads onto the fingers 46–48. However, other shapes may be implemented, if desired. A variety of suitable materials may be used for the cleaning pads 52 including sponge-like material, fibrous material, cotton padding or the like. Any accumulations of dirt on the cleaning pads may be removed by separately washing each of the pads or by directing a stream of water onto each pad, such as from a faucet or pressure cleaning device. Ideally, the spacing between adjacent pairs of cleaning pads is sufficiently small that the slats of the window blinds may slide between the pads without so much resistance as to cause damage to the slats. For example, if sufficiently resilient, the cleaning pads may actually contact one another and still permit the slats to slide between the pads. A desirable objective is for the cleaning pads 52 to provide sufficient sliding contact with the slats of the blinds that dirt, stains and the like are removed from the slats by moving the head 50 in the direction of the slats, such as up and down when the slats 27 are vertically disposed, as shown in FIG. 1.

Figure 4:
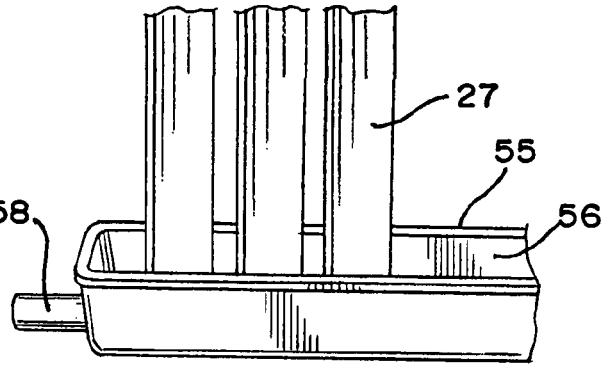
FIG. 4 is a perspective illustration of a drain pan disposed at the bottom of the blinds to collect any excess cleaning fluid.

Particularly with vertically disposed slats, the cleaning fluid may run down the slats before it can be removed by a subsequent vacuuming of the slats. FIG. 4 illustrates a drain pan 55 disposed below the slats 27 to catch any cleaning fluid runoff in the interior 56 of drain pan 55. Drain pan 55 may also be equipped with a drain tube 58 for returning used cleaning fluid that has drained into pan 55 to machine 22 in FIG. 1, or to any suitable drain.

Figure 5:
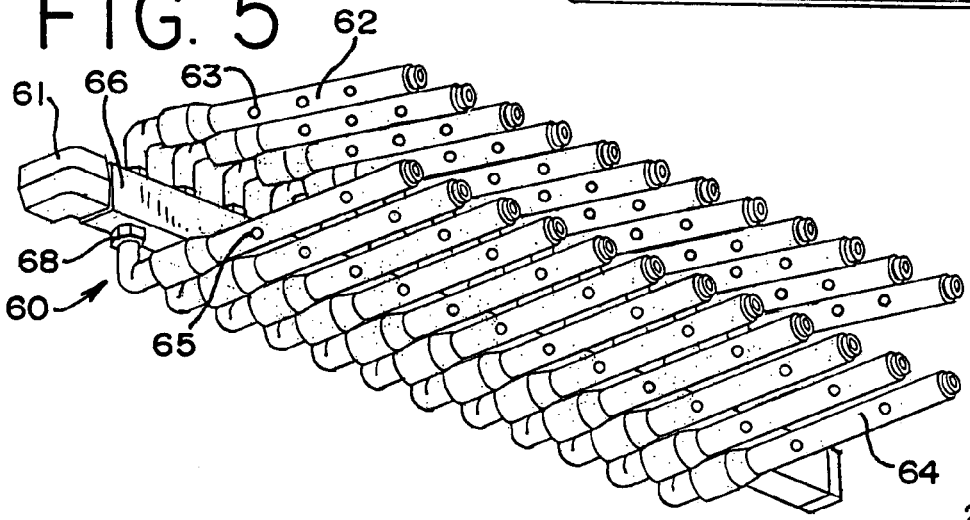
FIG. 5 is a cleaning head with two rows of spaced-apart fingers with one row suited to apply a cleaning fluid to the blinds and another row suited to apply a vacuum near the blinds to remove excess cleaning fluid.

Yet another embodiment of a cleaning head, generally designated 60, is illustrated in FIG. 5. Cleaning head 60 had two rows of fingers, including an upper row consisting of fingers 62 and a lower row consisting of fingers 64. Fingers 62 attach to an upper surface of a manifold 66 and lower fingers 64 attach to a lower surface of manifold 66, such as by threaded fasteners 68. An inlet end 61 of manifold 66 provides for cleaning fluid to the upper fingers 62, which may have finer orifices 63 for spraying the cleaning fluid onto the slats of the blinds. Inlet end 61 of manifold 66 also supplies a source of vacuum to lower fingers 64, which may have larger apertures 65 for removal of excess cleaning fluid, such as any fluid running down the slats of the blinds. Cleaning head 60 thus provides the cleaning fluid for cleaning of the window blinds and, at the same time, removes any excess cleaning fluid.

Figure 12:
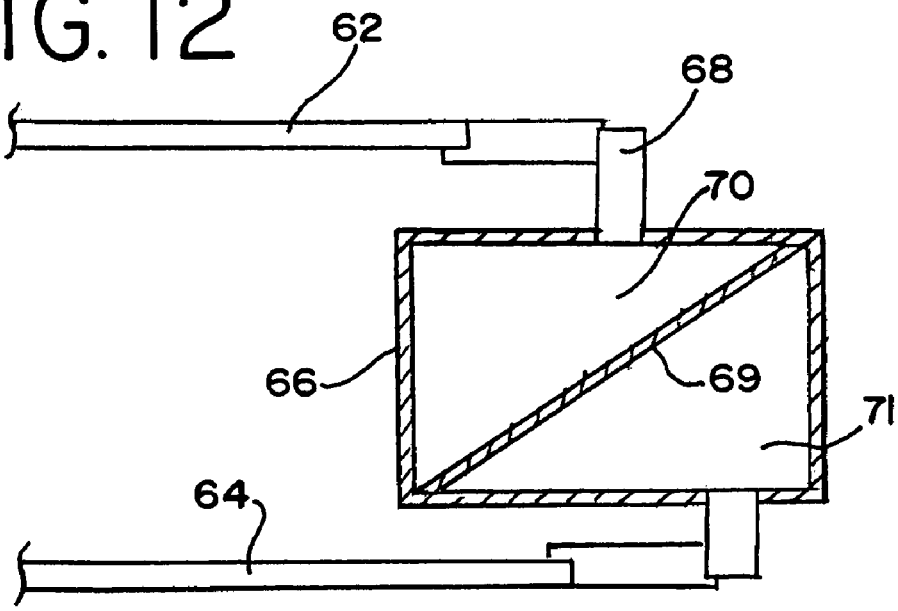
FIG. 12 is a diagrammatic view, taken partially in cross-section, of a cleaning head with two rows of fingers similar to the cleaning head of FIG. 5 in which the manifold in the cleaning head is divided for delivery of cleaning fluid to the fingers in one row and for application of vacuum to the fingers in the other row.

A typical cross-section of manifold 66 is shown in FIG. 12, wherein a longitudinally disposed divider 69 separates the interior of manifold 66 into a chamber 70 and a chamber 71. Of course, divider 69 could alternatively be disposed horizontally across the interior of manifold 66 if desired, instead of in the diagonal orientation shown in FIG. 12. In the illustrated example, chamber 70 is in fluid communication to supply cleaning fluid to the upper fingers 62 for spraying onto the slats of the blinds, and chamber 71 is in gaseous communication to supply vacuum to the lower fingers 64 for removal of excess cleaning fluid from the blinds.

Figure 10:
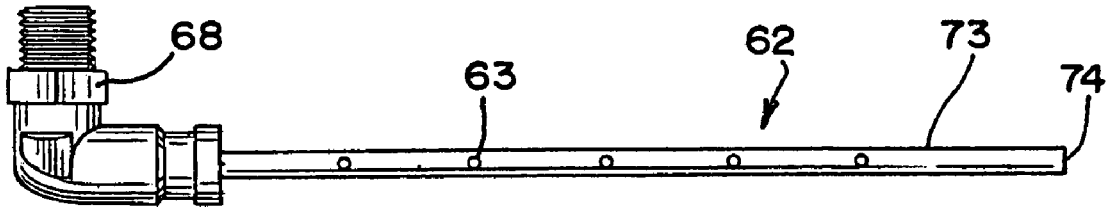
FIG. 10 is an elevational view of another embodiment of a cleaning finger that may be used in a window blind cleaning head in accordance with the present invention.

FIG. 10 illustrates a representative upper finger 62 in greater detail. Finger 62 may consist of an elongate tube which is closed or plugged at its distal end 74 and that is in fluid communication with a threaded fitting 68 at the other end. Cleaning fluid is thus distributed from the fitting 68, which attaches to manifold in FIGS. 5 and 12, to orifices 63. As with the orifices 36 in FIG. 1, the number of orifices 63, the size of the orifices, the spraying pattern of the orifices and the spacing between the orifices, depends upon various design choices.

Figure 11:
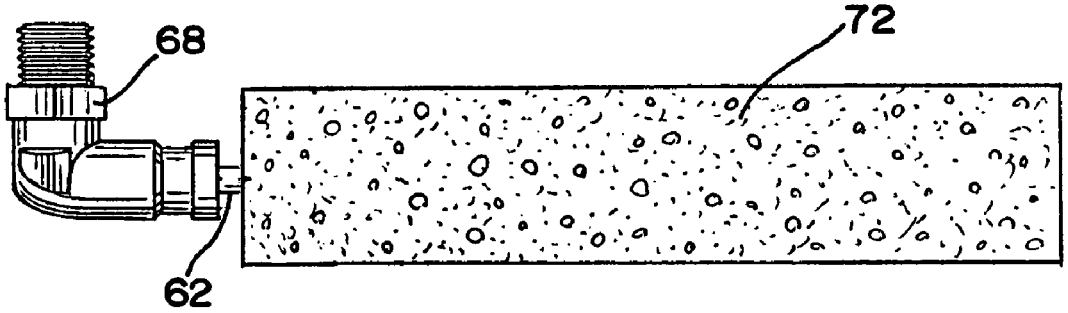
FIG. 11 is an elevational view of a cleaning finger suitable for use in a window blind cleaning head, similar to the finger of FIG. 10, but with a cleaning pad disposed over most of the finger.

Each of cleaning fingers 62 may also be equipped with a cleaning pad 72 as shown in FIG. 11. Cleaning pads 62 may be similar in composition and implemented in a manner similar to the cleaning pads 52 previously described above with reference to FIG. 3.

Figure 6:
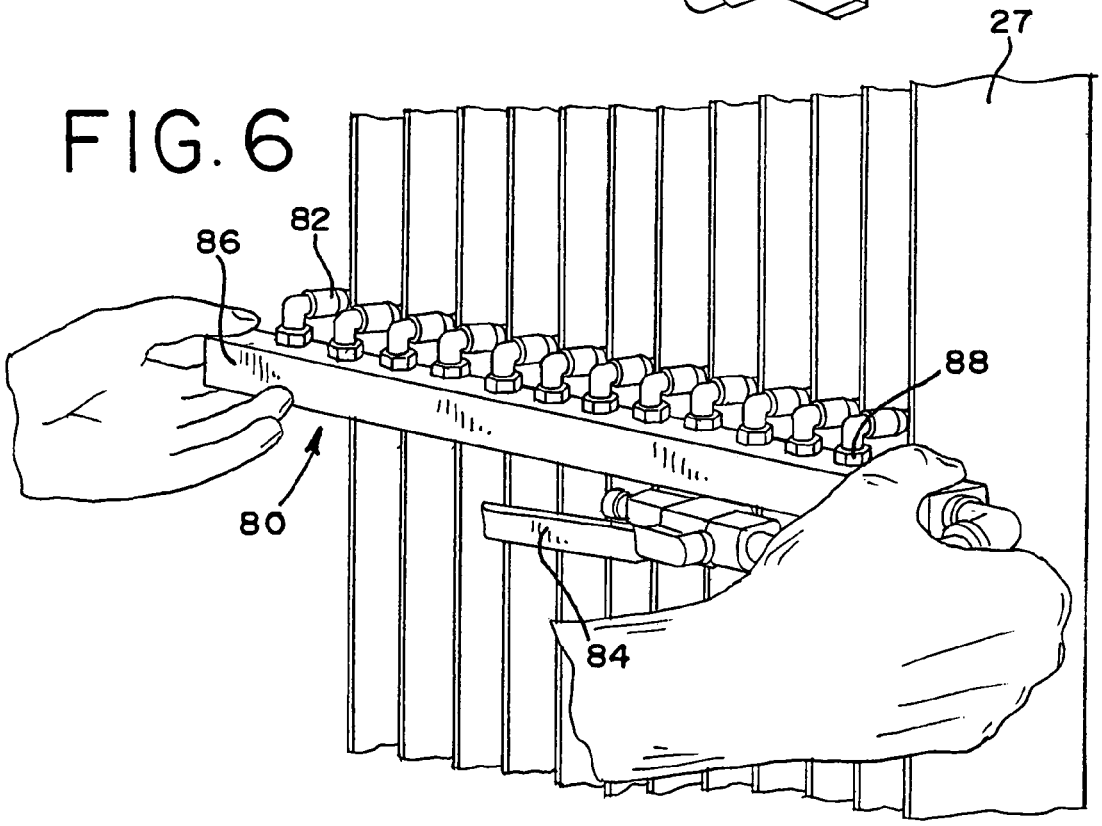
FIG. 6 is a perspective view of a cleaning head with a plurality of fingers disposed between the slats of a window blind in accordance with the present invention.

Returning to FIG. 6, a cleaning head 80 is shown with a plurality of fingers 82 disposed in a single row extend between adjacent slats 27 for cleaning of a window blind, with one finger 82 extending between adjacent slats. Fingers 82 are mounted to the upper surface of a manifold by means of a threaded fastener 88. A manually operable valve 84 selectively controls the application of cleaning fluid through manifold 86 and through fingers 82 to the slats 27. In this embodiment, the cleaning head 80 is manually held at opposite ends of manifold 86 and moved up and down to clean vertically disposed slats of the window blind.

Figure 7:
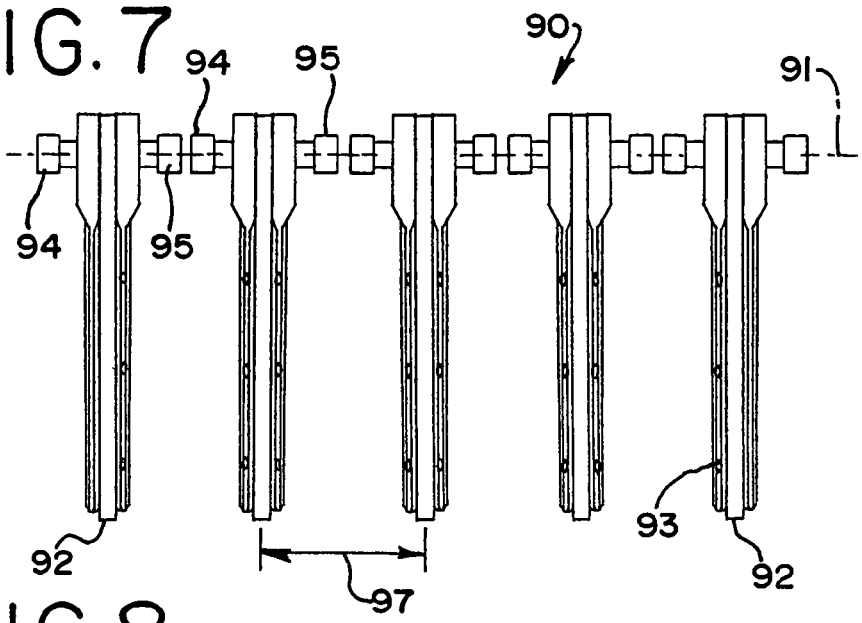
FIG. 7 is a top plan view of an alternate embodiment of a cleaning head for window blinds in which the plurality of fingers snap together such that the cleaning head can be quickly customized with the correct number of fingers for the number of slats in the window blind to be cleaned.

FIG. 7 illustrates yet another embodiment for a cleaning head, generally designated 90. In this embodiment, there is no separate manifold. Instead, each finger 92 is provided with a coupling 94 and 95 extending transversely from the finger 92 near one end of the finger. Couplings 94–95 are in general axial alignment, such as along an axis 91. Couplings 94 and 95 may be threaded to connect to a coupling of an adjacent finger, such as by a threaded nipple or the like. Alternatively, couplings 94 and 95 may be of an opposite type, such as male and female, to mate and engage directly to each other to provide fluid communication for the cleaning solution between each of the fingers 92 for spraying of the cleaning fluid through orifices 93. The amount of offset or extension of the couplings 94 and 95 from the fingers 92 will directly influence the spacing 97 between adjacent fingers 92, and the spacing 97 may be varied to provide cleaning heads 90 with different finger spacing 97, as desired. Of course, this cleaning head 90 may also have additional fingers 92 inserted or removed, as desired, to provide a cleaning head with the appropriate or desired number of fingers for the particular cleaning job.

Figure 8:
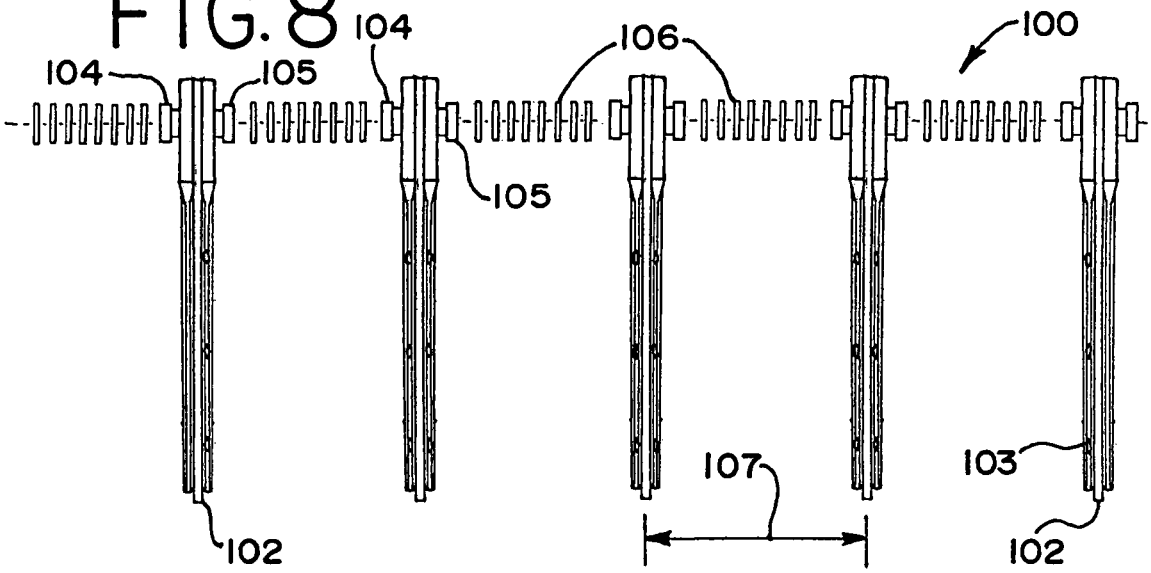
FIG. 8 is a top plan view, similar to FIG. 7, but with spacing elements disposed between the fingers of the cleaning head to adapt to the spacing between the slats of the window blind to be cleaned.

FIG. 8 illustrates another embodiment for a cleaning head, generally designated 100. Cleaning head 100 is similar to cleaning head 90 in FIG. 7 in that it does not have a separate manifold, such as the cleaning heads 26, 40, 50, 60 and 80, depicted in FIGS. 1–3 and 5–6. The fingers 102 may be narrower and longer than the fingers 92 in FIG. 7, as illustrated, or of the similar dimensions. Fingers 102 also employ couplings 104 and 105 to couple or mate a plurality of adjacent fingers into a cleaning head by the means described in cleaning head 90 of FIG. 7. However, cleaning head 100 in FIG. 8 also employs spacing elements 106, which may comprise a plurality of washer-like elements to vary the spacing 107 between adjacent pairs of fingers. Alternatively, spacing elements may be nipples or the like of different lengths to achieve the desired spacing. As with cleaning head 90, the number of fingers 102 utilized may be varied to suit the particular cleaning job.

Since cleaning heads 90 and 100 of FIGS. 7 and 8, respectively, are relatively inexpensive to fabricate from components that may be injection molded of a plastic material, such as PVC, users of these cleaning heads may want versions that have differing numbers of fingers with different finger spacing. For example, a user may want a five-finger cleaning head, an eight-finger cleaning head, and so forth, with different finger spacing so that there is only infrequent need to customize the head and finger spacing for the particular cleaning job. In this instance, it may be desirable to glue the PVC nipple spacing elements 106 of the desired length to the couplings 104–105, as is commonly done with PVC plumbing fittings, to create one or more customized cleaning heads with the desired number of fingers and with the desired finger spacing.

Figure 13:
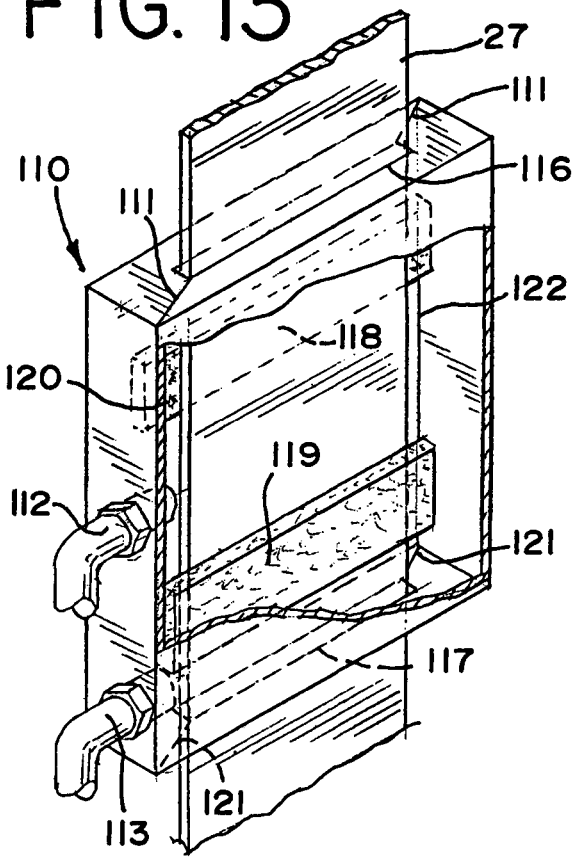
FIG. 13 is a perspective view of an enclosed cleaning compartment, in place of the fingers of the previous embodiments, with cleaning fluid and vacuum applied to the cleaning compartment with internal cleaning pads to slidingly engage the slat of the blind.
Figure 14:
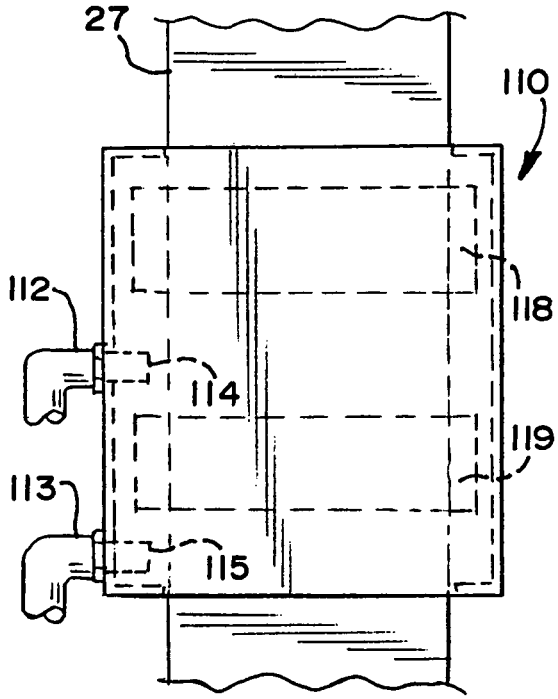
FIG. 14 is an elevational view of the cleaning compartment of FIG. 14.

FIGS. 13 and 14 illustrate apparatus for cleaning a slat of the window blinds with a closed compartment, generally designated 110. Compartment 110 is provided with an upper slot 116 in the top surface of the compartment and a lower slot 117 in the bottom surface of the compartment, which permits a slat 27 to extend through a central area of the compartment 110. Compartment 110 is divided along lines 111 in the upper surface and lines 121 in the lower surface, with a vertically disposed edge 120 acting as a live hinge. Thus, compartment 110 may be opened along an edge 122 to permit the slat 27 to be placed into the internal cleaning area of compartment, or to be removed therefrom upon completion of cleaning. Preferably, one or more cleaning surfaces or pads 118 and 119 are disposed on each side of slat 27 inside of the compartment to frictionally engage the slat for optimum cleaning thereof. A cleaning fluid tube 112 is disposed through one side of compartment 110. One or more apertures in the end of tube 112 spray cleaning fluid into the interior of the compartment, onto slat 27 and onto the cleaning pads 118 and 119. Thus, slat 27 is cleaned by moving the compartment 110 up and down along the length of slat 27. A cleaning fluid removal tube 113 is disposed through the side of compartment 110 near the bottom surface thereof. When tube 113 is connected to a source of vacuum, any excess cleaning fluid in the bottom of the compartment is removed through an aperture in the end of tube 113.

A plurality of compartments 110 may be arranged in the form of a cleaning head to simultaneously clean a plurality of slats of the window blind. For example, a compartment 110 could be attached to the ends of each pair of fingers 62 and 65 of the cleaning head 60 in FIG. 5, with the fingers changed to tubes 112 and 113, respectively. That is, orifices 63 and apertures 65 along the side of fingers 62 and 64 would be eliminated, and appropriate orifices and apertures would be provided in the ends of tubes 112 and 113 to provide the cleaning fluid into compartment 110, and to remove any excess cleaning fluid from the compartment.

While particular embodiments of the invention have been shown and described, it will be obvious to those skilled in the art that changes and modifications may be made therein without departing from the invention in its broader aspects.

The invention claimed is:

1. A cleaning head for cleaning a plurality of slats in a window blind, said cleaning head comprising:

a source of cleaning fluid to provide cleaning fluid under pressure;

a manifold in fluid communication with the source of cleaning fluid to receive the cleaning fluid;

a plurality of spaced apart fingers arranged in a row on said manifold, said plurality of spaced apart fingers each in fluid communication with said manifold to receive the cleaning fluid;

at least one orifice disposed in the side of each of said plurality of spaced apart fingers to spray the cleaning fluid onto the slats of the window blind;

said manifold divided into two chambers, one of said two chambers in fluid communication with said source of cleaning fluid and in fluid communication with said plurality of fingers to provide cleaning fluid to said plurality of fingers;

a source of vacuum in gaseous communication with said manifold;

a second plurality of spaced apart fingers arranged in a row on said manifold;

a second of said two chambers in the manifold in gaseous communication with said source of vacuum and with each of said second plurality of fingers; and at least one aperture defined in each of said second plurality of fingers, the vacuum at said aperture for removing excess cleaning fluid from said slat of the window blind.

2. The cleaning head for cleaning a plurality of slats in a window blind as claimed in accordance with claim 1, wherein said spaced apart fingers include an end finger at each end of the row and a plurality of interior fingers disposed between the end fingers, said interior fingers are each provided with at least one orifice in both sides of the interior fingers and said end fingers are provided with at least one orifice on the side adjacent to one of said interior fingers.

3. The cleaning head for cleaning a plurality of slats in a window blind as claimed in accordance with claim 1 further comprising:

an extendible mast disposed between said source of cleaning fluid under pressure and said manifold to provide fluid communication between said source of cleaning fluid and said manifold.

4. The cleaning head for cleaning a plurality of slats in a window blind as claimed in accordance with claim 1 further comprising:

a cleaning pad disposed about each of said plurality of fingers, said cleaning pad engaging said one of said slats when said one slat is disposed between a pair of said plurality of fingers.

5. A cleaning head for cleaning a plurality of slats in a window blind, said cleaning head comprising:

a plurality of fingers, each of said plurality of fingers having a pair of opposed sides;

at least one orifice defined in each of said plurality of fingers;

a coupling extending laterally from each of said opposed sides of each of said plurality of fingers; said couplings engageable to unite the plurality of fingers into a unitary cleaning head with spaced apart fingers aligned in a row, said couplings providing fluid communication from finger to finger and to said at least one orifice defined in each of said plurality of fingers.

6. The cleaning head for cleaning a plurality of slats in a window blind as claimed in accordance with claim 5, further comprising:

a spacing element disposed between the coupling extending laterally from the side of each of said plurality of fingers to change the amount of spacing between said plurality of spaced apart fingers.

* * * * *